US008939005B2

(12) United States Patent
Breen et al.

(10) Patent No.: US 8,939,005 B2
(45) Date of Patent: Jan. 27, 2015

(54) GUIDE PIN ASSEMBLY FOR METAL FORMING DIES AND METHOD

(71) Applicant: Standard Lifters, Inc., Grand Rapids, MI (US)

(72) Inventors: Scott M. Breen, Marne, MI (US); Joel T. Pyper, Grand Rapids, MI (US)

(73) Assignee: Standard Lifters, Inc., Grand Rapids, MI (US)

( * ) Notice: Subject to any disclaimer, the term of this patent is extended or adjusted under 35 U.S.C. 154(b) by 198 days.

(21) Appl. No.: 13/733,160

(22) Filed: Jan. 3, 2013

(65) Prior Publication Data

US 2014/0013816 A1 Jan. 16, 2014

Related U.S. Application Data

(60) Provisional application No. 61/611,135, filed on Mar. 15, 2012.

(51) Int. Cl.
*B21D 37/12* (2006.01)
*B21D 37/10* (2006.01)

(52) U.S. Cl.
CPC ..... *B21D 37/12* (2013.01)
USPC ..... 72/456

(58) Field of Classification Search
CPC ..... B21D 37/12; B21D 37/142; B21D 37/02; B21D 37/14; B21D 37/10
USPC ..... 72/343, 455, 456, 60; 164/385; 411/517, 353; 279/102; 29/525, 450, 29/451, 505, 520, 453; 100/918, 269.21; 403/288, 10
See application file for complete search history.

(56) References Cited

U.S. PATENT DOCUMENTS

| | | | |
|---|---|---|---|
| 2,487,233 | A | 11/1949 | Gerke |
| 2,663,180 | A | 12/1953 | Benedict |
| 3,126,922 | A | 3/1964 | Randlett et al. |
| 3,190,703 | A | 6/1965 | Thomson et al. |
| 3,474,656 | A | 10/1969 | Kraft |
| 3,514,166 | A | 5/1970 | Coley |
| 4,036,056 | A | 7/1977 | Saunders |
| 4,135,770 | A | 1/1979 | Doherty et al. |
| 4,199,313 | A | 4/1980 | Bohnenberger |
| 4,483,173 | A | 11/1984 | Duhamel |
| 4,696,180 | A | 9/1987 | Zandel |
| 4,732,033 | A | 3/1988 | Smedberg et al. |
| 4,742,746 | A | 5/1988 | Olsson |
| 4,796,460 | A | 1/1989 | Smedberg et al. |
| 4,900,017 | A | 2/1990 | Bold, Jr. |
| 4,926,563 | A | 5/1990 | Smith |
| RE33,940 | E | 5/1992 | Matsuo |

(Continued)

*Primary Examiner* — Shelley Self
*Assistant Examiner* — Gregory Swiatocha
(74) *Attorney, Agent, or Firm* — Price Heneveld LLP

(57) ABSTRACT

A guide pin assembly for metal forming dies includes a cylindrical guide pin body with an external retainer groove adjacent one end thereof in which a retainer ring is received. An annular guide pin ring with an outside diameter greater than the pin body, has a counterbore adjacent the outside end thereof and a retainer groove in a medial portion thereof which receives the outer portion of the retainer ring to securely interconnect the pin body and the ring and thereby form an enlarged head at one end of the pin body which positively limits reciprocal motion between two associated die members. A circular guide pin head cap covers the outer end of the head ring, and includes a support collar that is closely received in the counterbore of the ring, and engages the retainer ring to securely hold the same in place.

50 Claims, 4 Drawing Sheets

(56) References Cited

U.S. PATENT DOCUMENTS

| | | | | |
|---|---|---|---|---|
| 5,113,736 | A | 5/1992 | Meyerle | |
| 5,245,904 | A | 9/1993 | Meyerle | |
| 5,328,276 | A | 7/1994 | Linteau | |
| 5,397,135 | A | 3/1995 | Smith | |
| 5,722,280 | A | 3/1998 | Bodnar | |
| 5,758,374 | A | 6/1998 | Ronci | |
| 5,788,903 | A | 8/1998 | Allgaier | |
| 6,220,946 | B1 | 4/2001 | Arnold | |
| 6,408,728 | B1 | 6/2002 | Tsuji et al. | |
| 6,755,104 | B2 | 6/2004 | Grant | |
| 6,848,290 | B2 | 2/2005 | Pyper et al. | |
| 6,925,922 | B2 | 8/2005 | Manabe et al. | |
| 6,986,273 | B2 | 1/2006 | Rager | |
| 7,000,446 | B2 | 2/2006 | Nieschulz et al. | |
| 7,004,007 | B2 | 2/2006 | Kruger et al. | |
| 7,114,365 | B2 | 10/2006 | Rooney, Jr. et al. | |
| 7,152,451 | B1 * | 12/2006 | Cotter | 72/361 |
| 7,326,092 | B2 | 2/2008 | Fedder et al. | |
| 8,074,515 | B2 | 12/2011 | Van Kann et al. | |
| 8,291,603 | B2 | 10/2012 | Saegesser et al. | |
| 2009/0193865 | A1 | 8/2009 | Pyper et al. | |
| 2011/0192206 | A1 * | 8/2011 | Cotter | 72/60 |
| 2011/0296893 | A1 * | 12/2011 | Breen et al. | 72/343 |

* cited by examiner

GUIDE PIN ASSEMBLY FOR METAL FORMING DIES AND METHOD

CLAIM OF PRIORITY

The present application is related to commonly assigned, U.S. provisional patent application Ser. No. 61/611,135, filed Mar. 15, 2012, entitled GUIDE PIN ASSEMBLY FOR METAL FORMING DIES AND METHOD, which is incorporated herein by reference, and claims priority thereto under 35 U.S.C. §119.

BACKGROUND OF THE INVENTION

The present invention relates to metal forming dies and the like, and in particular to a guide pin assembly and associated method.

Metal forming dies, such as stamping dies and the like, are well known in the art. Progressive metal forming dies are unique, very sophisticated mechanisms which have multiple stations or progressions that are aligned longitudinally, and are designed to perform a specified operation at each station in a predetermined sequence to create a finished metal part. Progressive stamping dies are capable of forming complex metal parts at very high speeds, so as to minimize manufacturing costs.

Heretofore, the dies used in metal forming presses have typically been individually designed, one of a kind assemblies for a particular part, with each of the various components being handcrafted and custom mounted or fitted in an associated die set, which is in turn positioned in a stamping press. Not only are the punches and the other forming tools in the die set individually designed and constructed, but the other parts of the die set, such as stock lifters, guides, end caps and keepers, cam returns, etc., are also custom designed and installed in the die set. Current die making processes require carefully machined, precision holes and recesses in the die set for mounting the individual components, such that the same are quite labor intensive, and require substantial lead time to make, test and set up in a stamping press. Consequently, such metal forming dies are very expensive to design, manufacture, and repair or modify.

Recently, some components for metal forming dies have been pre-constructed using a modular design that is installed in a die set as a complete unit, instead of custom making each of the component parts and assembling them in the die set. One such modular die component is Applicant's "Guided Keeper," which is the subject of U.S. Pat. Nos. 7,950,262, 8,074,486, and others, which are hereby incorporated herein by reference, and has met with substantial commercial success in reducing the overall cost of manufacturing metal forming dies. While such modular components are very advantageous, further improvements to reduce the manufacturing costs of metal forming dies generally, as well as such modular components, and improve quality and strength would clearly be advantageous. Hence, a guide pin assembly construction and associated method which simplifies the manufacturing process, reduces lead time and inventories, and minimize manufacturing costs, as well as improved performance, would clearly be advantageous.

SUMMARY OF THE INVENTION

One aspect of the present invention is a guide pin assembly for metal forming dies having first and second die members which mutually converge and diverge to form metal parts. The guide pin assembly includes a guide pin body having a generally cylindrical shape, with a predetermined outside diameter. The guide pin body includes a first end portion configured for secure operable attachment with the first die member, a second end portion disposed generally opposite the first end portion, and configured to be received into an associated aperture in the second die member, a medial portion disposed between the first and second end portion, and having a generally hard, smooth, finished exterior surface for precisely guiding converging and diverging motion between the first and second die members, and a first retainer groove extending circumferentially about the exterior surface at an axial location disposed generally adjacent to the second end portion of the guide pin body, and having a generally arcuate shape that opens radially outwardly. The guide pin assembly also includes a guide pin head ring having a generally annular plan configuration, a generally cylindrically shaped exterior sidewall with a predetermined outside diameter that is greater than the outside diameter of the guide pin body, a generally circularly shaped interior sidewall with a predetermined inside diameter that is generally commensurate with the outside diameter of the guide pin body, a generally annularly shaped outwardly facing end edge, and a generally annularly shaped inwardly facing end edge. The guide pin head ring also includes a second retainer groove extending circumferentially about a medial portion of the interior sidewall, and has a generally arcuate shape that opens radially inwardly, and is generally axially aligned with the first retainer groove in the guide pin body when the guide pin assembly is in an assembled condition. The guide pin head ring also includes a counterbore formed into the outwardly facing end edge of the guide pin head ring, recessed into the interior sidewall of the guide pin head ring and extending generally axially from the outwardly facing end edge to the second retainer groove, and defines a counterbore wall. The guide pin assembly also includes a retainer ring having a radially inward portion thereof closely received and retained in the first retainer groove in the guide pin body, and a radially outwardly portion protruding radially outwardly from the exterior surface of the guide pin body and being closely received and retained in the second retainer groove in the guide pin head ring to fixedly axially mount the guide pin head ring on the second end portion of the guide pin body and define an enlarged head portion of the guide pin assembly that serves to positively limit travel between the first and second die members. The guide pin head assembly also includes a guide pin head cap having a generally circular plan configuration, an outwardly oriented exterior face, an inwardly oriented interior face, and a generally annularly shaped support collar protruding axially inwardly from the interior face of the guide pin head cap, with a radially interior sidewall defining a socket in which the second end portion of the guide pin body is received, and a radially exterior sidewall which is closely received against the counterbore wall, such that the support collar is retained in the counterbore in the guide pin head ring and captures the retainer ring in the first retainer groove in the guide pin body and the second retainer groove in the guide pin head cap, such that the guide pin head ring is securely supported on the second end portion of the guide pin body to withstand impact forces applied to the enlarged head portion of the guide pin assembly during repeated, mutual convergence and divergence of the first and second die members.

Yet another aspect of the present invention is a metal forming die having first and second die members which mutually converge and diverge to form metal parts in combination with an improved guide pin assembly. The guide pin assembly includes a guide pin body having a generally cylindrical shape, with a predetermined outside diameter, a first end portion operably attached to the first die member, a second end portion disposed generally opposite the first end portion, and received in an associated aperture in the second die member, a medial portion disposed between the first and second end portions, and having a generally hard, smooth finished exterior surface for precisely guiding the converging and diverging motion between the first and second die members, and a first retainer groove extending circumferentially about the exterior surface at an axial location disposed generally adjacent to the second end portion of the guide pin body, and having a generally arcuate shape that opens radially outwardly. The guide pin assembly also includes a guide pin head ring having a generally annular plan configuration, a generally cylindrically shaped exterior sidewall with a predetermined outside diameter that is greater than the predetermined outside diameter of the guide pin body, a generally cylindrically shaped interior sidewall with a predetermined inside diameter that is generally commensurate with the predetermined outside diameter of the guide pin body, a generally annularly shaped outwardly facing end edge, and a generally annularly shaped inwardly facing end edge. The guide pin head ring also includes a second retainer groove extending circumferentially about a medial portion of the interior sidewall, and having a generally arcuate shape that opens radially inwardly, and is generally axially aligned with the first retainer groove in the guide pin body when the guide pin assembly is in an assembled condition. The guide pin head ring further includes a counterbore formed into the outwardly facing end edge of the guide pin head ring, recessed into the interior sidewall of the guide pin head ring and extending generally axially from the outwardly facing end edge to the second retainer groove, and defining a counterbore wall. The guide pin assembly further includes a retainer ring having a radially inward portion thereof closely received and retained in the first retainer groove in the guide pin body, and a radially outward portion thereof, protruding radially outwardly from the exterior surface of the guide pin body and being closely received and retained in the second retainer groove in the guide pin head ring to fixedly axially mount the guide pin head ring on the second end portion of the guide pin body and define an enlarged head portion of the guide pin assembly that serves to positively limit travel between the first and second die members. The guide pin assembly also includes a guide pin head cap having a generally circular plan configuration, an outwardly oriented exterior face, an inwardly oriented interior face, and a generally annularly shaped support collar protruding axially inwardly from the interior face of the guide pin head cap, with a radially interior sidewall defining a socket in which the second end portion of the guide pin body is received, and a radially exterior sidewall which is closely received against the counterbore wall, such that the support collar is retained in the counterbore in the guide pin head ring, and captures the retainer ring in the first retainer groove in the guide pin body and the second retainer groove in the guide pin head cap, such that the guide pin head ring is securely supported on the second end of the guide pin assembly during repeated, mutual convergence and divergence of the first and second die members.

Yet another aspect of the present invention is a method for making a guide pin assembly for metal forming dies of the type having first and second die members which mutually converge and diverge to form metal parts. The method comprises forming a guide pin body with a generally cylindrical shape, a predetermined outside diameter, a first end portion configured for secure operable attachment with the first die member, a second end portion disposed generally opposite the first end portion and configured to be received into an associated aperture in the second die member, and a medial portion disposed between the first and second end portions, and having a generally hard, smooth finished exterior surface for precisely guiding a converging and diverging motion between the first and second die members. The method further includes forming a first retainer groove in the guide pin body, extending circumferentially about the exterior surface thereof at a location disposed generally adjacent to the second end portion of the guide pin body with a generally arcuate shape that opens radially outwardly. The method further includes forming a guide pin head ring with a generally annular plan configuration, a generally circularly shaped exterior sidewall having a predetermined outside diameter that is greater than the predetermined outside diameter of the guide pin body, a generally cylindrically shaped interior sidewall with a predetermined inside diameter that is generally commensurate with the predetermined outside diameter of the guide pin body, a generally annularly shaped outwardly facing end edge, and a generally annularly shaped inwardly facing end edge. The method further includes forming a second retainer groove in the guide pin ring head extending circumferentially about a medial portion of the interior sidewall with a generally arcuate shape that opens radially inwardly, and is generally axially aligned with the first retainer groove in the guide pin body when the guide pin assembly is in an assembled condition. The method further includes forming a counterbore into the outwardly facing end edge of the guide pin head ring that is recessed into the interior sidewall of the guide pin head ring, extends generally axially from the outwardly facing end edge to the second retainer groove, and defines a counterbore wall. The method further includes providing a retainer ring having a radially inward portion shaped for close reception in the first retainer groove in the guide pin body, and a radially outward portion shaped for close reception in the second retainer groove in the guide pin head ring. The method further includes forming a guide pin head cap with a generally circular plan configuration, an outwardly oriented exterior face, an inwardly oriented interior face, and a generally annularly shaped support collar protruding axially inwardly from the interior face of the guide pin head cap and having a free end edge, having a radially interior sidewall defining a socket shape to closely receive therein the second end portion of the guide pin body, and a radially exterior sidewall shaped to be closely received against the counterbore wall. The method further includes positioning the radially inward portion of the retainer ring in the first retainer ring groove in the guide pin body, and sliding the guide pin head ring onto and over the guide pin body from the first end portion thereof until the guide pin head ring contacts at least a portion of the retainer ring mounted in the first retainer groove on the guide pin body. The method further includes positioning the guide pin head cap over the outwardly facing end edge of the guide pin head ring with at least a portion of the second end portion of the guide pin body received in the socket in the guide pin head cap, at least a portion of the support collar of the guide pin head cap received in the counterbore in the guide pin head ring. The method further includes converging the guide pin head cap and the guide pin head ring until at least a portion of the free end edge of the support ring on the guide pin head cap contacts at least a portion of the retainer ring mounted in the first retainer groove on the guide pin body. The method further includes pressing the guide pin head cap and the guide pin head ring together, causing engagement of the free end edge of the support ring against the retainer ring mounted in the first retainer groove on the guide pin body, thereby shifting the radially outward portion of the retainer ring into the second retainer groove in the guide pin head ring to fixedly axially mount the guide pin head ring on the second end portion of the guide pin body and define an enlarged head portion of the guide pin assembly that serves to positively limit travel between the first and second die members. The method further includes further pressing the guide pin head cap and the guide pin head ring together until the second end portion of the guide pin body is fully received in the socket in the guide pin head cap, the support collar portion of the guide pin head cap is fully received in the counterbore in the guide pin head ring, and the inwardly oriented interior face of the guide pin head cap abuts with the outwardly facing end edge of the guide pin head ring to positively capture the retainer ring in the first retainer groove in the guide pin body and the second retainer groove in the guide pin head ring, and rigidly supports the guide pin head ring on the second end portion of the guide pin body to withstand impact forces applied to the enlarged head portion of the guide pin assembly during repeated, mutual convergence and divergence of the first and second die members.

Yet another aspect of the present invention is a method for making a metal forming die of the type having first and second die members which mutually converge and diverge to form metal parts. The method includes forming a guide pin body with a generally cylindrical shape, a predetermined outside diameter, a first end portion configured for secure operable attachment with the first die member, and a second end portion disposed generally opposite the first end portion and configured to be received into an associated aperture in the second die member, and a medial portion disposed between the first and second end portions, and having a generally hard, smooth finished exterior surface for precisely guiding the converging and diverging motion between the first and second die members. The method further includes forming a first retainer groove in the guide pin body, which extends circumferentially about the exterior surface at an axial location disposed generally adjacent to the second end portion of the guide pin body and has a generally arcuate shape that opens radially outwardly. The method further includes forming a guide pin head ring with a generally annular plan configuration, a generally cylindrically shaped exterior sidewall having a predetermined outside diameter that is greater than the predetermined outside diameter of the guide pin body, a generally cylindrically shaped interior sidewall with a predetermined inside diameter that is generally commensurate with the predetermined outside diameter of the guide pin body, a generally annularly shaped outwardly facing end edge, and a generally annularly shaped inwardly facing end edge. The method further includes forming a second retainer groove in the guide pin head ring which extends circumferentially about a medial portion of the interior sidewall and has a generally arcuate shape that opens radially inwardly, and is generally axially aligned with the first retainer groove in the guide pin body when the guide pin assembly is in an assembled condition. The method further includes forming a counterbore into the outwardly facing end edge of the guide pin head ring that is recessed into the interior sidewall of the guide pin head ring, extends generally axially from the outwardly facing end edge to the second retainer groove, and defines a counterbore wall. The method further includes providing a retainer ring having a radially inward portion shaped for close reception in the first retainer groove in the guide pin body, and a radially outward portion shaped for close reception and the second retainer groove in a guide pin head ring. The method further includes forming a guide pin head cap with a generally circular plan configuration, an outwardly oriented exterior face, an inwardly oriented interior face, and a generally annularly shaped support collar protruding axially inwardly from the interior face of the guide pin end cap, having a free end edge, a radially interior sidewall defining a socket shape to closely receive therein the second end portion of the guide pin body, and a radially exterior sidewall shaped to be closely received against the counterbore wall. The method further includes positioning the radially inward portion of the retainer ring in the first retainer groove in the guide pin body, and sliding the guide pin head ring onto and over the guide pin body from the first end portion thereof until the guide pin head ring contacts at least a portion of the retainer ring mounted in the first retainer groove on the guide pin body. The method further includes positioning the guide pin head cap over the outwardly facing end edge of the guide pin head ring with at least a portion of the second end portion of the guide pin body received in the socket in the guide pin head cap, at least a portion of the support collar of the guide pin head cap received in the counterbore in the guide pin head ring. The method further includes converging the guide pin head cap and the guide pin head ring until at least a portion of the free end edge of the support ring on the guide pin head cap contacts at least a portion of the retainer ring mounted in the first retainer groove on the guide pin body. The method further includes pressing the guide pin head cap and the guide pin head ring together, causing engagement of the free end edge of the support ring against the retainer ring mounted in the first retainer groove on the guide pin body, and thereby shifting the radially outward portion of the retainer ring into the second retainer ring groove in the guide pin head ring to fixedly axially mount the guide pin head ring on the second end portion of the guide pin body and define an enlarged head portion of the guide pin assembly that serves to positively limit travel between the first and second die members. The method further includes further pressing the guide pin head cap and the guide pin head ring together until the second end portion of the guide pin body is fully received in the socket in the guide pin head cap, the support collar of the guide pin head cap is fully received in the counterbore in the guide pin head ring, and the inwardly oriented interior face of the guide pin head cap abuts with the outwardly facing end edge of the guide pin head ring to positively capture the retainer ring in the first retainer groove in the guide pin body and the second retainer groove in the guide pin head ring, and rigidly support the guide pin head ring on the second end portion of the guide pin body. The method further includes mounting the first end portion of the guide pin on the first die member, and positioning the second end portion of the guide pin body in an associated aperture in the second die member, such that the enlarged head portion of the guide pin assembly positively and accurately limits travel between the first and second die members during repeated, mutual convergence and divergence of the first and second die members.

Yet another aspect of the present invention is a guide pin assembly having an uncomplicated construction which is economical to manufacture, and very strong and durable during use. Designed interferences between the various parts of the guide pin assembly provide a secure locking function when the parts are assembled. The guide pin head ring elastically deforms both circumferentially and radially outwardly when the guide pin head ring is pressed on the guide pin body to snap the retainer groove in the guide pin head ring over and onto the radially outward portion of the retainer ring, and thereafter apply radially inwardly oriented resilient constricting forces against the retainer ring that securely retains the retainer ring in place without adversely affecting the function of the guide pin assembly. A slight taper may be placed on the outer edge of the guide pin head ring prior to assembly, which flattens straight after the parts have been assembled. The guide pin head cap has a support collar that fills the void between the retainer ring and the adjacent parts to securely support the guide pin head ring when it is subjected to high forces. The guide pin head ring requires no anti-rotation feature, since it can rotate without affecting its function. Assembly of the guide pin assembly is preferably accomplished in one single pressing action, wherein the guide pin head cap drives the retainer ring into the guide pin head ring seat, and is then inelastically deformed to ensure the parts are fully seated. The guide pin head cap is dimensioned to create a seamless appearance on the enlarged head portion of the guide pin assembly, wherein the tangent of the radius on the cap matches the straight on the ring component. Preferably, the marginal edge of the guide pin head cap is quite thin, and is designed to deform rather than allow the parts to be separated. The guide pin head cap can be easily etched or otherwise marked with appropriate indicia before assembly, and preferably has a common size regardless of the length of the guide pin to which it will be assembled. A dampener groove in the guide pin allows a dampening washer retained therein to compress and bulge bi-directionally under normal working conditions, keeping the washer from fanning only outwardly under high loads, and further helps keep the dampening washer in place under all load conditions. The guide pin assembly is efficient in use, economical to manufacture, capable of long operating life, and particularly well adapted for the proposed use.

These and other advantages of the invention will be further understood and appreciated by those skilled in the art by reference to the following written specification, claims, and appended drawings.

DETAILED DESCRIPTION

Figure 1:
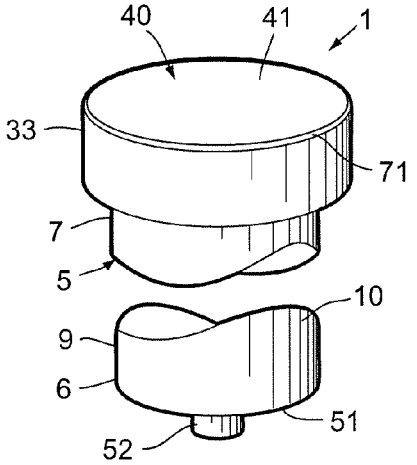
FIG. 1 is a fragmentary perspective view of a guide pin assembly embodying the present invention.
Figure 2:
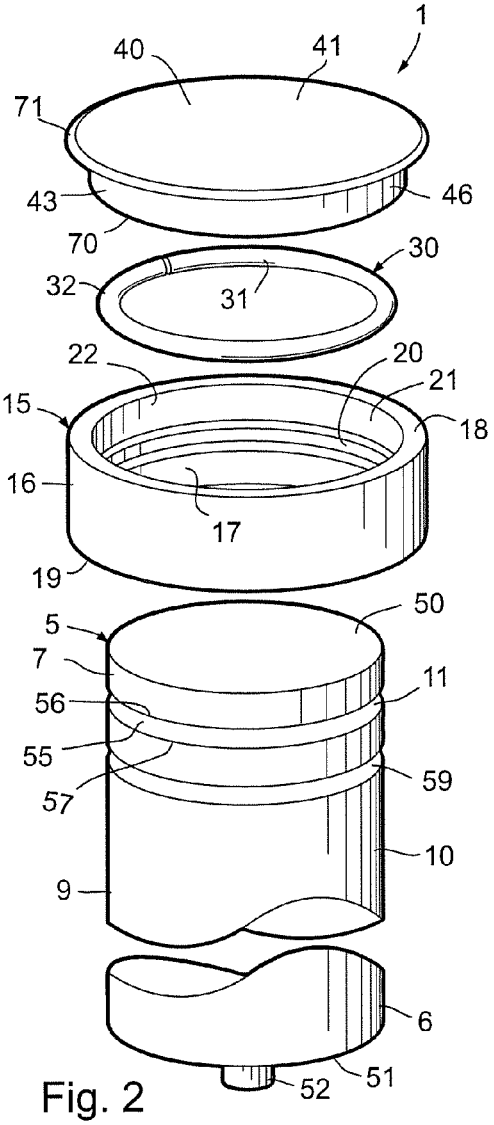
FIG. 2 is an exploded perspective view of the guide pin assembly.

For purposes of description herein, the terms "upper," "lower," "right," "left," "rear," "front," "vertical," "horizontal" and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
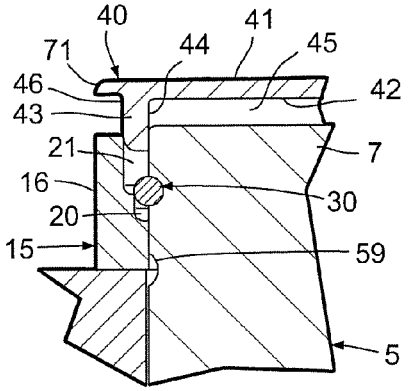
FIG. 3 is a fragmentary cross-sectional view of the guide pin assembly, shown with a guide pin head cap portion thereof in a first partially assembled condition.
Figure 4:
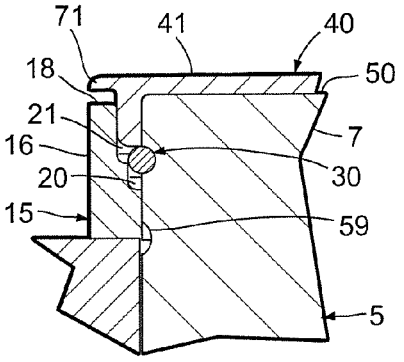
FIG. 4 is a fragmentary cross-sectional view of the guide pin assembly, wherein the guide pin head cap is shown in a second partially assembled condition.
Figure 5:
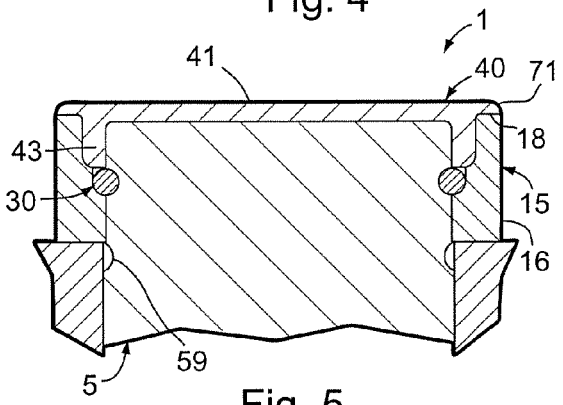
FIG. 5 is a cross-sectional view of the guide pin assembly, shown supported on a press base, and with the guide pin head cap shown pressed into a fully installed condition.
Figure 6:
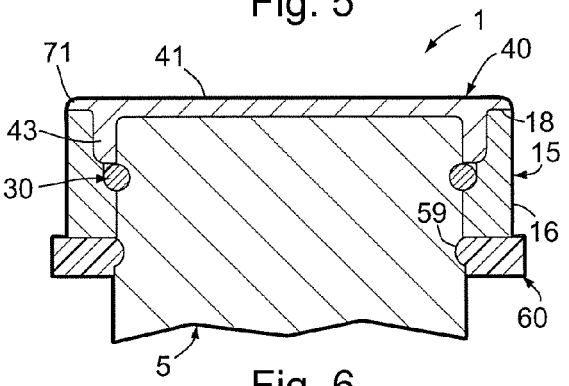
FIG. 6 is a fragmentary cross-sectional view of the guide pin assembly shown in the fully assembled condition.
Figure 7:
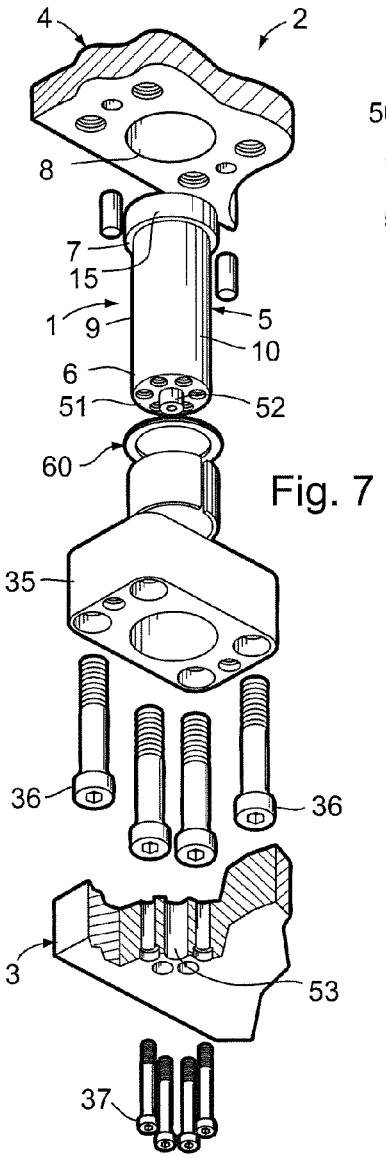
FIG. 7 is an exploded perspective view of the guide pin assembly, shown installed in a guided keeper between two associated die members.

The reference numeral 1 (FIGS. 1-7) generally designates a guide pin assembly embodying the present invention, which is particularly adapted for use in conjunction with metal forming dies, such as the die 2, selected portions of which are shown in FIG. 7, which has first and second die members 3 and 4, respectively, that mutually converge and diverge to form metal parts. Guide pin assembly 1 includes a guide pin body 5 having a generally cylindrical shape with a predetermined outside diameter. Guide pin body 5 includes a first end portion 6 configured for secure operable attachment with the first die member 3, and a second end portion 7, which is disposed generally opposite the first end portion 6, and is configured to be received into an associated aperture 8 in the second die member 4. The guide pin body 5 also includes a medial portion 9 disposed generally between the first and second end portions 6, 7, respectively, and having a generally hard, smooth, finished exterior surface 10 for precisely guiding the converging and diverging motion between the first and second die members 3 and 4. The guide pin body 5 also includes a first retainer groove 11, which extends circumferentially about the exterior surface 10 at an axial location disposed generally adjacent to the second end portion 7 of the guide pin body 5, and has a generally arcuate shape that opens radially outwardly. The guide pin assembly 1 also includes a guide pin head ring 15 which has a generally annular plan configuration, and includes a generally cylindrically shaped exterior sidewall 16 with a predetermined outside diameter that is greater than the outside diameter of the guide pin body 5, a generally cylindrically shaped interior sidewall 17 with a predetermined inside diameter that is generally commensurate with the predetermined outside diameter of the guide pin body 5, a generally annularly shaped outwardly facing end edge 18, and a generally annularly shaped inwardly facing end edge 19. The guide pin head ring 15 also includes a second retainer groove 20 extending circumferentially about a medial portion of the interior sidewall 17, which has a generally arcuate shape that opens radially inwardly, and is generally axially aligned with the first retainer groove 11 in the guide pin body 5 when the guide pin assembly 1 is in an assembled condition, as shown in FIGS. 1, 6, 7, 23 and 29. A counterbore 21 is formed into the outwardly facing end edge 18 of guide pin head ring 15, is recessed into the interior sidewall 17 of guide pin head ring 15, and extends generally axially from the outwardly facing end edge 18 to the second retainer groove 20 to define a counterbore wall 22. The guide pin assembly 1 also includes a retainer ring 30, which has a radially inward portion 31 closely received and retained in the first retainer groove 11 in the guide pin body 5, and a radially outward portion 32, which protrudes radially outwardly from the exterior surface 10 of the guide pin body 5, and is closely received and retained in the second retainer groove 20 in the guide pin head ring 15, so as to fixedly axially mount the guide pin head ring 15 on the second end portion 7 of the guide pin body 5 and define an enlarged head portion 33 of the guide pin assembly 1 that serves to positively limit travel between the first and second die members 3, 4. The guide pin assembly 1 also includes a guide pin head cap 40, which has a generally circular plan configuration, and includes an outwardly oriented exterior face 41, an inwardly oriented interior face 42 and a generally annularly shaped support collar 43 which protrudes axially inwardly from the interior face 42 of guide pin head cap 40. The support collar 43 of guide pin head cap 40 has a radially interior sidewall 44 (FIG. 3) which defines a socket 45 in which the second end portion 7 of the guide pin body 5 is received, and a radially exterior sidewall 46 which is closely received against the counterbore wall 22 in the guide pin head ring 15, such that the support collar portion 43 of the guide pin head cap 40 is tightly retained in the counterbore 21 in the guide pin head ring 15, and the retainer ring 30 is positively captured in the first retainer groove 11 in the guide pin body 5 and the second retainer groove 20 in the guide pin head ring 15, such that the guide pin head ring 15 is securely supported on the second end portion 7 of the guide pin body 5 to withstand impact forces applied to the enlarged head portion 33 of the guide pin assembly 1 during repeated, mutual convergence and divergence of the first and second die member 3, 4.

As will be appreciated by those having skill in the art of metal forming dies, metal forming dies typically incorporate multiple pairs of plates which converge and diverge relative to one another, and serve to either form the metal stock strip, and/or advance the stock strip through the various stations of the metal forming dies. Various tools and/or components are normally mounted on these die plates to achieve the desired forming of the metal stock and/or advancement through the die. These pairs of metal plates are typically interconnected by guide pins, which serve not only to accurately align each plate in the pair for precise reciprocation, but also act as a retainer to positively limit to a predetermined amount the distance each pair of plates may be separated from one another, so as to insure proper synchronization between the various stations and/or operations being performed in the metal forming die. Examples of such components are stock lifters, guided keepers, pressure plates, die shoes, die set pins and the like. Consequently, it should be understood that the term "die member," as used herein refers to any portion of a metal forming die or die set, including, but not limited to, an upper die member or die shoe, a lower die member, all other die components, whether stationary or reciprocating, including a reciprocating pressure pad, or the like. In the example illustrated in FIG. 7, guide pin assembly 1 is shown used in conjunction with a guided keeper assembly, wherein the base portion 35 of the guided keeper is operably connected with the second die member 4, by bolts 36, and the lower end 6 of the guide pin body 5 is operably connected with the first die member 3 by bolts 37. However, as will be appreciated by those skilled in the art, guide pin assembly 1 can be mounted in other types of die members, and/or components in a variety of different positions and orientations, as necessary to manipulate and form the stock strip as it advances through the various work stations of an associated metal forming die.

Figure 8:
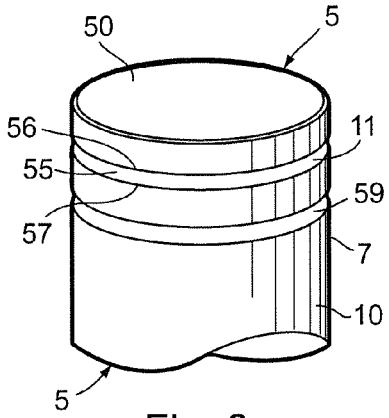
FIG. 8 is a fragmentary perspective view of a guide pin body portion of the guide pin assembly.
Figure 9:
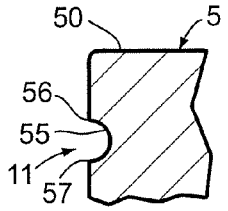
FIG. 9 is an enlarged, cross-sectional view of a first retainer groove in the guide pin body.
Figure 10:
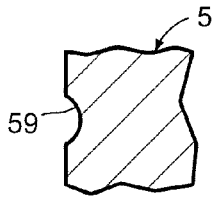
FIG. 10 is an enlarged, cross-sectional view of a dampener groove in the guide pin body.
Figure 11:
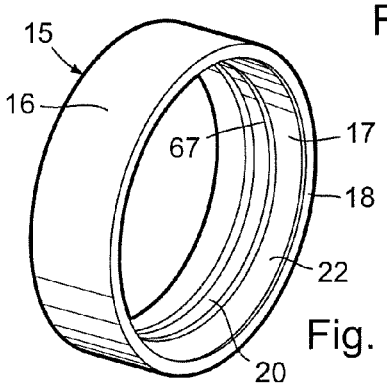
FIG. 11 is a perspective view of the guide pin head ring.
Figure 12:
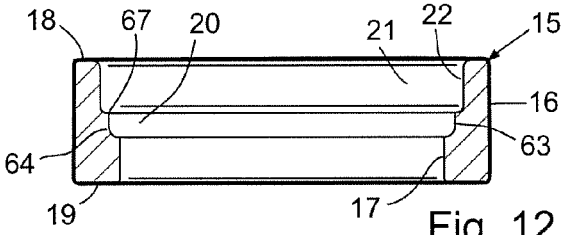
FIG. 12 is a cross-sectional view of the guide pin head ring.
Figure 13:
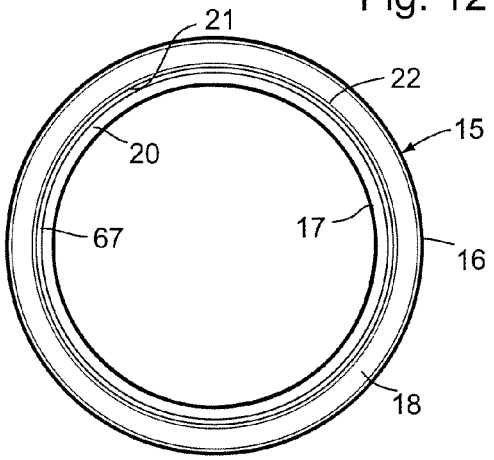
FIG. 13 is a top plan view of the guide pin head ring.
Figure 14:
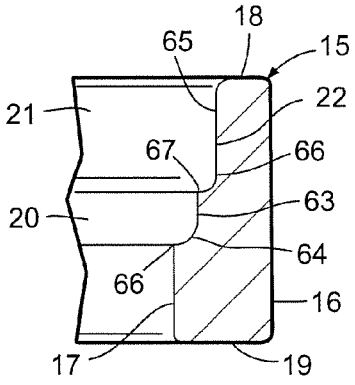
FIG. 14 is an enlarged, fragmentary, cross-sectional view of a portion of the guide pin head ring.
Figure 17:
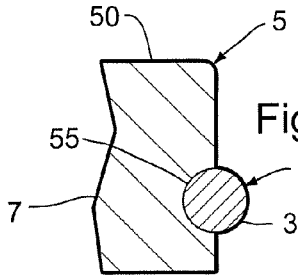
FIG. 17 is an enlarged, fragmentary, cross-sectional view of the retainer ring mounted in the first retainer groove in the guide pin body.
Figure 18:
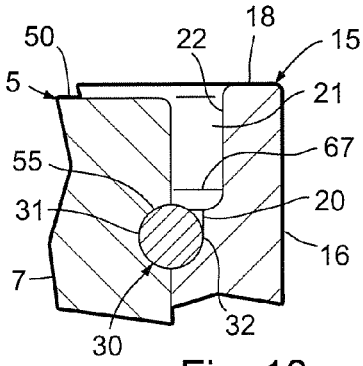
FIG. 18 is an enlarged, fragmentary, cross-sectional view of the guide pin body, the retainer ring and the guide pin head ring shown in a fully assembled condition.
Figure 19:
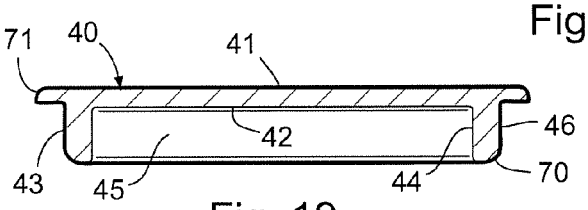
FIG. 19 is a cross-sectional view of the guide pin head cap.
Figure 20:
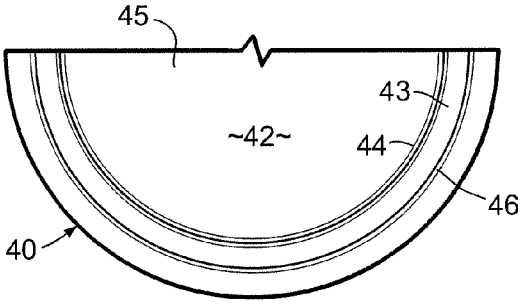
FIG. 20 is a fragmentary bottom plan view of the guide ring head cap.
Figure 21:
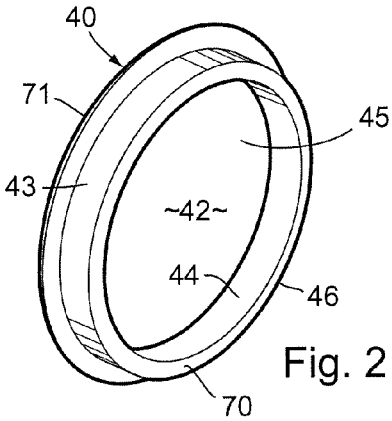
FIG. 21 is a perspective view of the guide ring head cap.

With reference to FIGS. 7-10, the illustrated guide pin body 5 has a rigid, one-piece construction, and can be machined from a solid bar or rod of metal or the like, such as steel. The illustrated guide pin body 5 has a flat, circularly shaped upper end 50, and an opposite, generally flat and circular lower end 51. In the example illustrated in FIGS. 1-7, the lower end 51 of guide pin body 5 includes an outwardly protruding, central locator pin 52, which is closely received in a mating locator aperture 53 in the first die member 3, as best illustrated in FIG. 7. As will be appreciated by those having ordinary skill in the art, the lower end 51 of guide pin body 5 may be equipped with different types of locator mechanisms so as to ensure proper alignment between guide pin body 5 and the two die members 3, 4. With reference to FIGS. 8-10, the first retainer groove 11 in the illustrated guide pin body 5 is defined by a first groove surface 55, which has a generally circular cross-sectional shape, that opens radially outwardly, and extends from a first groove edge 56 along the circular groove surface 55 to a base or bottom portion, and then to the opposite groove edge 57. The first retainer groove 11 has a predetermined groove depth that is measured radially between the bottom or base portion and the exterior sidewall 10 of the guide pin body 5. In the illustrated example, the first retainer groove 11 in guide pin body 5 has a cross-sectional shape that is generally semi-circular in configuration, as best shown in FIGS. 9, 17 and 18, although other shapes and sizes are also contemplated by the present invention. The illustrated guide pin body 5 also includes a bumper groove 59 which is disposed axially between the first retainer groove 11 and the lower end 51 of guide pin body, and has a generally arcuate shape that opens radially outwardly. As best illustrated in FIG. 6, and described in greater detail below, the bumper groove 59 receives and loosely retains therein a resilient bumper 60 constructed from urethane or the like, which serves to absorb impact energy generated during the convergence and divergence of the two die members 3, 4. The illustrated resilient dampening bumper 60 is in the form of a washer having an annular plan shape with a circular interior sidewall that extends over the bumper groove 59 in a non-impacted condition, and extends into the bumper groove 59 in an impact condition, as shown in FIG. 6, to bi-directionally absorb impact forces applied to the enlarged head portion 33 of the guide pin assembly 1 during operation of the associated metal forming die 2.

Figure 15:
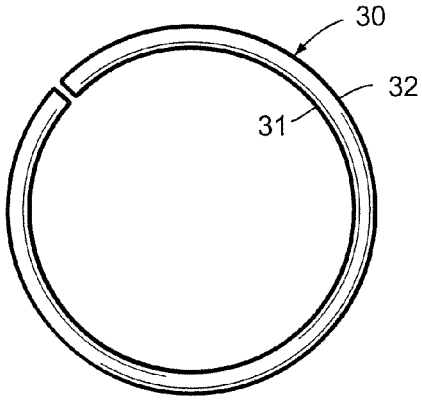
FIG. 15 is a plan view of a retainer ring portion of the guide pin assembly.
Figure 16:
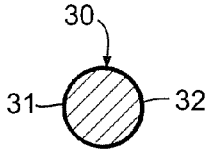
FIG. 16 is a cross-sectional view of the retainer ring.

With reference to FIGS. 2, 15 and 16, the illustrated retainer ring 30 has a split, one-piece, circular plan construction that is made from a single piece of solid spring steel wire, rod, or the like. Retainer ring 30 is generally flat or planar along its opposite sides or faces, has a circular lateral cross-sectional body shape, as shown in FIG. 16, and a split circular plan shape, as shown in FIG. 15. The opposite ends 34 of retainer ring 30 are separated by a predetermined amount, preferably in the range of 0.03 inches to 0.10 inches, and the body of retainer ring 30 is resiliently flexible, so that it can expand and contract circumferentially and/or radially, thereby permitting the interior or inward side 31 of retainer ring 30 to be snapped into the outwardly opening first retainer groove 11 in the guide pin body 5, and also permitting the inwardly opening second retainer groove 20 in the guide pin head ring 15 to be snapped over and onto the exterior side 32 of retainer ring 30, as explained in greater detail below. The outside diameter of the circular body portion of retainer ring 30 as shown in FIG. 16, is specifically selected to create an interference fit with the retainer groove 11 in guide pin body 5, and the retainer groove 20 in guide pin head ring 15, so as to create a very strong and durable guide pin assembly 1. In one working embodiment of the present invention, retainer ring 30 is a conventional C-ring having a planar outside diameter of 1.835 inches, a planar inside diameter of 1.635 inches, and a solid circular cross section shape with a diameter of 0.100 inches. In the illustrated example, the radially inward portion 31 of retainer ring 30 has a shape and size that is generally commensurate with the shape and size of the first retainer groove surface 55, such that the same is abuttingly supported closely against groove surface 55. Further, the illustrated retainer ring 30 is configured such that approximately all of the radially inward half 31 is closely received and retained in retainer groove 11, while approximately all of the radially outward half 32 protrudes radially outwardly from the exterior surface 10 of guide pin body 5.

With reference to FIGS. 11-14, the illustrated guide pin head ring 15 has a rigid, one-piece construction, and can be machined from a solid bar or rod of metal or the like, such as steel. The second retainer groove 20 in the illustrated guide pin head ring 15 has a generally J-shaped configuration, which as best illustrated in FIGS. 11-14, includes a generally linear, axially extending leg portion 63 at the outermost side thereof, and a generally circular radially inwardly extending leg portion 64 at the innermost portion thereof. In the illustrated example, the counterbore 15 also has a generally J-shaped configuration, which as best illustrated in FIGS. 11-14, includes a generally linear, axially extending leg portion 65 at the outermost side thereof, and a generally circular, radially inwardly extending leg portion 66 at the innermost portion thereof. Both retainer groove 20 and counterbore 21 have a circular plan shape, and are arranged axially concentrically. The circular leg portion 66 of counterbore 21 and the straight leg portion 63 of retainer groove 20 intersect along a radially inwardly oriented rim 67, which has a circular plan shape and a predetermined plan diameter that is less than the predetermined outside diameter of the retainer ring 30, such that the guide pin head ring 40 must be pressed over and onto the guide pin body 5, thereby creating an interference fit between the retainer ring 30 and the walls or surfaces 55, 63 and 64 of the first and second retainer grooves 11, 20. In one working example of the present invention, which will be discussed in greater detail hereinafter, the retainer ring 30 is first snapped into the first retainer groove 11 in guide pin body 5, and a pressing machine is then used to press guide pin head ring 15 over and onto the guide pin body 5, thereby creating an interference fit between the retainer ring 30 and the surfaces 55, 63 and 64 of the first and second retainer grooves 11, 20. In the noted working example, the amount of interference between the rim 67 in the interior portion of guide pin head ring 15, and the radially outward portion 32 of retainer ring 30, when placed in the partially assembled condition shown in FIGS. 22 and 25-27, is around 0.002 inches per side, or a total of around 0.004 inches, such that a mechanical press in the range of 5-20 tons has been found satisfactory for such an assembly. In other words, in the noted working example, the diameter of rim 67 is formed approximately 0.004 inches smaller than the outside diameter of the associated retainer ring 30. It is to be understood that the amount of interference fit between the retainer ring 30 and the first and second retainer ring grooves 11 and 20, as well as rim 67 will vary according to the size of guide pin assembly 1, and the specific application for its use in a metal forming die.

Figure 22:
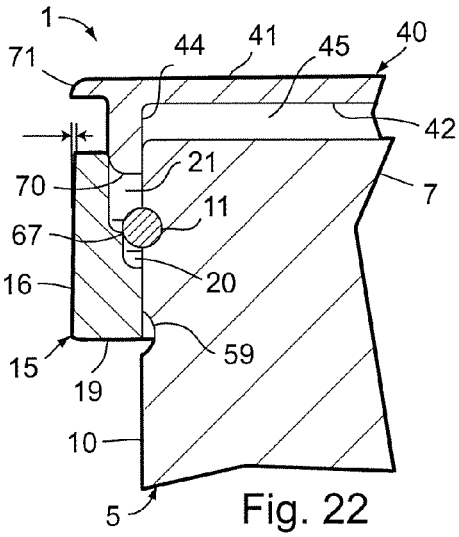
FIG. 22 is an enlarged, fragmentary, cross-sectional view of the guide pin assembly shown in the first partially assembled condition.
Figure 23:
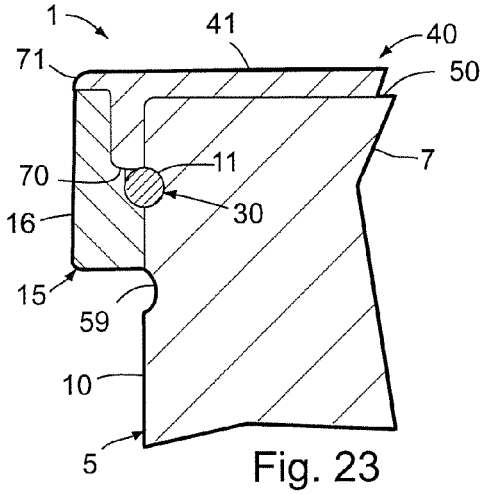
FIG. 23 is an enlarged, fragmentary cross-sectional view of the guide pin assembly shown in the fully assembled condition.

Furthermore, in the illustrated example, the guide pin head ring 15 is constructed of a rigid material having sufficient radial and circumferential resiliency that the guide pin head ring 15 elastically deforms both circumferentially and radially outwardly when the guide pin head ring 15 is pressed onto the guide pin body 5 to snap the second retainer groove 20 over and onto the radially outwardly portion 32 of the retainer ring 30. The guide pin head ring 15, in this elastically deformed installed condition, thereafter applies radially inwardly oriented resilient constricting forces against the retainer ring 30 and guide pin body 5, which serve to securely retain the retainer ring 30 in the first and second retainer grooves 11, 20 of the guide pin body 5 and the guide pin head ring 15 when the guide pin assembly 1 is in the fully assembled condition. As best shown in FIGS. 22 and 23, in order to compensate for the slight elastic deformation of the guide pin head ring 15 which would otherwise result after assembly, the exterior side wall 16 of the guide pin head ring 15 preferably has a pre-assembled shape (FIG. 22) that tapers radially inwardly adjacent the outwardly facing end edge 18 of the guide pin head ring 15, such that the radially oriented circumferential elastic deformation of the guide pin head ring 15, which occurs during pressing of the same onto the guide pin body 5, shifts the configuration of the exterior side wall 16 of the guide pin head ring 15 from the tapered pre-assembled shape to a substantially cylindrical post assembly shape (FIG. 23) when the guide pin assembly 1 is in the fully assembled condition. Consequently, the exterior side wall 16 of the guide pin head ring 15 has a substantially cylindrical, finished assembled shape.

The counterbore 21 in the illustrated guide pin head ring 15 defines an annular slot with a predetermined width, as measured radially between the interior sidewall 17 of the guide pin head ring 15 and the counterbore wall 22, which is particularly adapted for the secure connection of the guide pin head cap 40 in counterbore 21, as discussed below.

Figure 28:
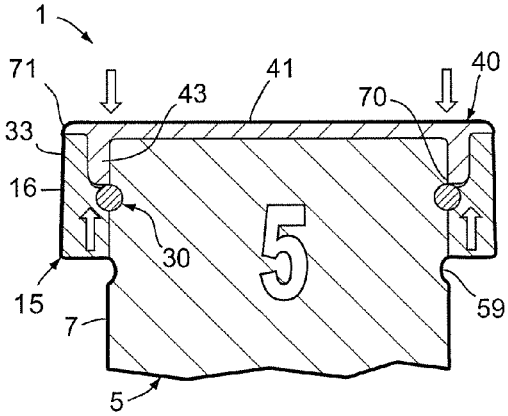
Figure 29:
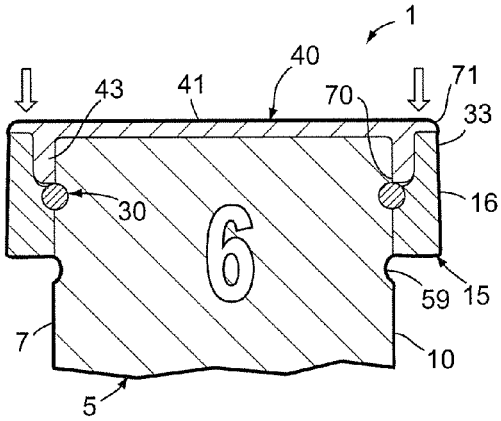

The illustrated guide pin head cap 40 has a rigid, one-piece construction, and can be machined from a solid bar or rod of metal or the like, such as steel. The support collar portion 43 of guide pin head cap 40 has a predetermined width measured radially between the interior sidewall 44 and the exterior sidewall 46 of the support collar 43, which width is greater than the predetermined width of the counterbore 21 as noted above, such that the guide pin head cap 40 is pressed axially onto the guide pin head ring 15 with an interference fit between the support collar portion 43 of the guide pin head cap 40 and the counterbore wall 22 of the guide pin head ring 15. Furthermore, the support collar portion 43 of the illustrated guide pin head cap 40 includes an inwardly facing free end edge 70, which abuts at least a portion of the retainer ring 40 when the guide pin assembly 1 is in the assembled condition, and assists in positively capturing the retainer ring 30 in the first and second retainer grooves, 11, 20 in the guide pin body 1 and the guide pin head ring 15. In the illustrated example, when the guide pin assembly 1 is being pressed into the assembled condition, as shown in FIGS. 28-29, the support collar portion 43 of the guide pin head cap 40 is inelastically deformed to completely fill any open space between the exterior surface 10 of the guide pin body 5 and the counterbore wall 22 in the guide pin head ring 15, as well as any open space between the retainer ring 30 and the second retainer groove 20 in the guide pin head ring 15, so as to ensure that all parts of the guide pin assembly 1 are fully and solidly seated to withstand repeated, high impact forces. Also, in the illustrated example, the outwardly oriented face 41 of the guide pin head cap 40 includes a tapered outer marginal edge 71 which extends to, but no further than, the radially outermost portion of the outwardly facing end edge 18 of the guide pin head ring 15 to present a solid appearance for the enlarged head portion 33 of the guide pin assembly 1, and also to discourage removal of the guide pin head cap 40 from the guide pin head ring 15. More specifically, the very thin nature of the tapered outer marginal edge of guide pin head cap 40, which in the illustrated example is arcuate in shape, causes the same to deform when pried upon, rather than separating the guide pin head cap 40 from the guide pin head ring 15. Also, the flat exterior surface 41 of guide pin head cap 40 is particularly adapted to accept permanent markings and/or similar indicia, particularly before assembly, such as by etching or the like, so as to provide clean and long lasting manufacturing information, etc. that can be used with various guide pin body lengths.

As will be appreciated by those skilled in the art, because the primary mechanical connection between guide pin body 5 and guide pin head ring 15 is provided by retainer ring 30, a permanent connection between these parts can be achieved without the need for a guide pin head cap 40, although use of the latter is preferred for most commercial applications. Furthermore, guide pin assembly 1 does not require any anti-rotation mechanism for the enlarged head 33, as a result of the unique locking system achieved by retainer ring 30.

Figure 24:
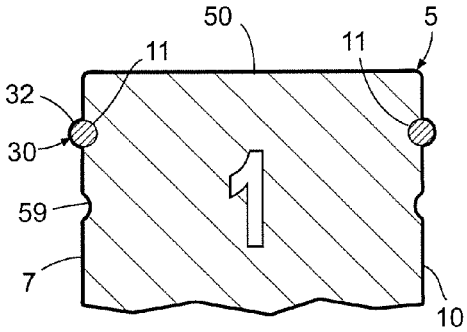
FIGS. 24-29 are partially diagrammatic, cross-sectional views of one preferred sequence for assembling the guide pin body, the guide pin head ring, the retainer ring and the guide pin head cap portions of the guide pin assembly.
Figure 25:
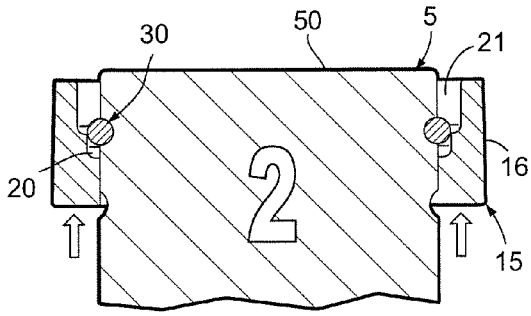
Figure 26:
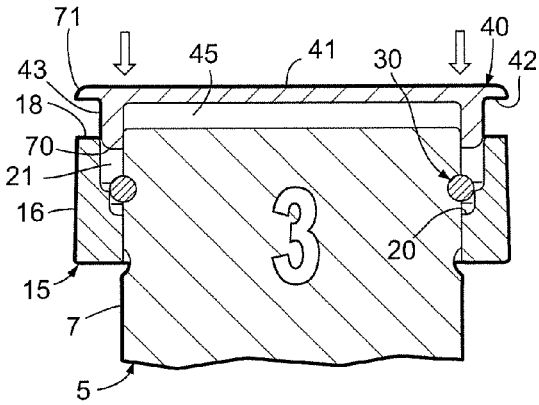
Figure 27:
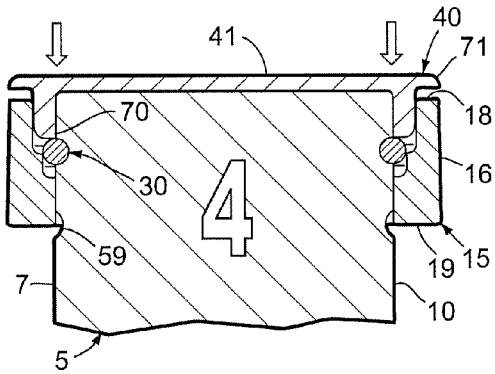

In one working embodiment of the present invention, the guide pin body 5, guide pin head ring 15, retainer ring 30 and guide pin head cap 40 are assembled in the fashion shown in FIGS. 24-29. Initially, retainer ring 30 is pressed over the outer surface 10 of guide pin body 5 and into the first retainer groove 11, as shown in FIG. 24. Since retainer ring 30 is split, it opens circumferentially at the split to facilitate movement over the upper portion of guide pin body 5, and then snaps securely into the first retainer groove 11 in guide pin body 5. Preferably, when retainer ring 30 is initially so installed in the retainer groove 11 of guide pin body 5, it is tensed circumferentially from its "as manufactured" shape, so as to achieve close shutting contact with groove surface 55. Next, as shown in FIG. 25, the guide pin head ring 15 is then inserted over the outside surface 10 of guide pin body 5 from the lower end 51 thereof toward the upper end 50 thereof, until the interior rim 67 on the guide pin head ring 15 contacts the exterior surface of retainer ring 30. Next, as shown in FIG. 26, the support collar portion 43 of the guide pin head cap 40 is inserted into the gap formed between the outside surface 10 of guide pin body 5 and the counterbore wall 22 in guide pin head ring 15. The upper end 7 of guide pin body 5 closely received into the socket 45 formed on the interior face 42 of guide pin head cap 40. Next, as shown in FIG. 27, the guide pin head cap 40 is pressed axially into the guide pin head ring 15 until the free end edge 70 of the collar portion 43 of guide pin head cap 40 abuts or otherwise engages the outer surface of the retainer ring 30. Next, the guide pin head cap 40 and guide pin head ring 15 are axially pressed convergingly together until the contact between the free end edge 70 of the support collar portion 43 of the guide pin head cap 40 is sufficient to cause the second retainer groove 20 in guide pin head ring 15 to snap past rim 67 and onto the radially outward portion 32 of retainer ring 30, as shown in FIG. 28. Finally, further axial convergence of the guide pin head cap 40 and the guide pin head ring 15 causes the support collar portion 43 of the guide pin head cap 40 to inelastically deform to completely fill any open space between the exterior surface 10 of the upper end 7 of guide pin body 5 and the counterbore wall 22 in the guide pin head ring 15, as well as any open space between the retainer ring 30 and the second retainer groove 20 in the guide pin head ring 15, so as to ensure that all parts of the guide pin assembly 1 are fully seated, and rigidly support the enlarged head portion 33 of the guide pin assembly 1 on the second end 7 of the guide pin body 5 to withstand repeated high impact forces. Preferably, each pressing step is performed as a substantially continuous, single action operation in a pressing machine or the like to achieve a tight, permanent connection of the various parts, and reduce manufacturing costs.

Guide pin assembly 1 has an uncomplicated construction which is economical to manufacture, very strong and durable during use. Designed interferences between the various parts of the guide pin assembly 1 provide a secure locking function when the parts are fully assembled. The guide pin head ring 15 elastically deforms both circumferentially and radially outwardly when the guide pin head ring 15 is pressed onto the guide pin body 5 to snap the retainer groove 20 in the guide pin head ring 15 over and onto the radially outward portion of the retainer ring 30, and thereafter applies radially inwardly oriented resilient constricting forces against the retainer ring 30 and guide pin body 5 that securely retain the retainer ring 30 in place, without adversely affecting the function of the guide pin assembly 1. A slight taper is placed on the outer edge of the guide pin head ring 15, which stretches into a circular shape or cylinder after the parts have been fully assembled.

In the foregoing description, it will be readily appreciated by those skilled in the art that modifications may be made to the invention without departing from the concepts disclosed herein, such modifications are to be considered as included in the following claims, unless these claims by their language expressly state otherwise.

The invention claimed is:

1. A guide pin assembly for metal forming dies having first and second die members which mutually converge and diverge to form metal parts, comprising:

a guide pin body having a generally cylindrical shape, with a predetermined outside diameter, and including:

a first end portion configured for secure operable attachment with the first die member;

a second end portion disposed generally opposite said first end portion, and configured to be received into an associated aperture in the second die member;

a medial portion disposed between said first and second end portions, and having a generally hard, smooth finished exterior surface for precisely guiding the converging and diverging motion between the first and second die members;

a first retainer groove extending circumferentially about said exterior surface at an axial location disposed generally adjacent to said second end portion of said guide pin body, and having a generally arcuate shape that opens radially outwardly;

a guide pin head ring having a generally annular plan configuration, and including:

a generally cylindrically shaped exterior sidewall with a predetermined outside diameter that is greater than said predetermined outside diameter of said guide pin body, a generally cylindrically shaped interior sidewall with a predetermined inside diameter that is generally commensurate with said predetermined outside diameter of said guide pin body, a generally annularly shaped outwardly facing end edge, and a generally annularly shaped inwardly facing end edge;

a second retainer groove extending circumferentially about a medial portion of said interior sidewall, and having a generally arcuate shape that opens radially inwardly, and is generally axially aligned with said first retainer groove in said guide pin body when said guide pin assembly is in an assembled condition;

a counterbore formed into said outwardly facing end edge of said guide pin head ring, recessed into said interior sidewall of said guide pin head ring and extending generally axially from said outwardly facing end edge to said second retainer groove, and defining a counterbore wall;

a retainer ring having a radially inward portion thereof closely received and retained in said first retainer groove in said guide pin body, and a radially outward portion thereof protruding radially outwardly from said exterior surface of said guide pin body and being closely received and retained in said second retainer groove in said guide pin head ring to fixedly axially mount said guide pin head ring on said second end portion of said guide pin body and define an enlarged head portion of said guide pin assembly that serves to positively limit travel between the first and second die members; and a guide pin head cap having a generally circular plan configuration, and including:

an outwardly oriented exterior face;

an inwardly oriented interior face; and a generally annularly shaped support collar protruding axially inwardly from said interior face of said guide pin head cap, with a radially interior side wall defining a socket in which said second end portion of said guide pin body is received, and a radially exterior sidewall which is closely received against said counterbore wall, such that said support collar is securely retained in said counterbore in said guide pin head ring and said retainer ring is positively captured in said first retainer groove in said guide pin body and said second retainer groove in said guide pin head ring, such that said guide pin head ring is securely supported on said second end portion of said guide pin body to withstand impact forces applied to said enlarged head portion of said guide pin assembly during repeated, mutual convergence and divergence of the first and second die members.

2. A guide pin assembly as set forth in claim 1, wherein:

said retainer ring has a generally annular plan shape with a predetermined outside diameter associated with said radially outward portion thereof, and a generally circular radial cross-sectional configuration;

said first retainer groove in said guide pin body is defined by a first arcuate groove surface having a shape and size that is generally commensurate with the shape and size of said radially inward portion of said retainer ring and abuttingly supports the same against said first arcuate groove surface; and said second retainer groove and said counterbore wall in said guide pin head ring intersect along a radially inwardly oriented rim which has a predetermined plan diameter that is less than said predetermined outside diameter of said retainer ring, whereby said guide pin head ring is pressed over and onto said guide pin body with an interference fit between said retainer ring and said first and second retainer grooves.

3. A guide pin assembly as set forth in claim 2, wherein:

said guide pin head ring is constructed of a rigid material having sufficient radial resiliency that said guide pin head ring elastically deforms both circumferentially and radially outwardly when said guide pin head ring is pressed onto said guide pin body to snap said second retainer groove over and onto said radially outward portion of said retainer ring, and thereafter apply radially inwardly oriented resilient constricting forces against said retainer ring that securely retain said retainer ring in said first and second retainer grooves in said guide pin body and said guide pin head ring when said guide pin assembly is in said assembled condition.

4. A guide pin assembly as set forth in claim 3, wherein:

said counterbore of said guide pin head ring has a predetermined width measured radially between said interior sidewall of said guide pin head ring and said counterbore wall; and said support collar of said guide pin head cap has a predetermined width measured radially between said interior sidewall and said exterior sidewall of said support collar, which is greater than said predetermined width of said counterbore, such that said guide pin head cap is pressed axially onto said guide pin head ring with an interference fit between said support collar of said guide pin head cap and said counterbore wall of said guide pin head ring.

5. A guide pin assembly as set forth in claim 4, wherein:

said support collar of said guide pin head cap includes an inwardly facing free end edge which abuts at least a portion of said retainer ring when said guide pin head ring is pressed onto said guide pin body to assist shifting said second retainer groove over and onto said radially outward portion of said retainer ring.

6. A guide pin assembly as set forth in claim 5, wherein:

said guide pin assembly is machine pressed into said assembled condition, such that said support collar of said guide pin head cap is inelastically deformed to completely fill any open space between said exterior surface of said guide pin body and said counterbore wall in said guide pin head ring, as well as any open space between said retainer ring and said second retainer groove in said guide pin head ring, so as to insure that all parts of said guide pin assembly are fully and solidly seated, to withstand repeated, high impact forces.

7. A guide pin assembly as set forth in claim 6, wherein:

said exterior sidewall of said guide pin head ring has an assembled shape that is substantially cylindrical when said guide pin assembly is in said assembled condition; and said exterior sidewall of said guide pin head ring has a preassembled shape that tapers radially inwardly adjacent said outwardly facing end edge thereof, such that the radially oriented circumferential elastic deformation of said guide pin head ring which occurs during pressing of the same onto said guide pin body shifts the configuration of said exterior sidewall of said guide pin head ring from said tapered preassembled shape to said substantially cylindrical assembled shape when said guide pin assembly is in said assembled condition.

8. A guide pin assembly as set forth in claim 7, wherein:

said inwardly oriented interior face of said guide pin head cap abuts against said outwardly facing end edge of said guide pin head ring when said guide pin assembly is in said assembled condition.

9. A guide pin as set forth in claim 8, wherein:

said outwardly oriented face of said guide pin head cap includes a tapered outer marginal edge which extends to, but no further than, the radially outermost portion of said outwardly facing end edge of said guide pin head ring to present a solid appearance for said enlarged head portion of said guide pin assembly, and discourage removal of said guide pin head cap from said guide pin head ring.

10. A guide pin assembly as set forth in claim 9, including:

a bumper groove extending circumferentially about said exterior surface of said guide pin body at an axial location disposed immediately inwardly of said inwardly facing end edge of said guide pin head ring in said assembled condition, and having a generally arcuate shape that opens radially outwardly; and a resilient dampening washer having an annular plan shape with a circular interior side wall that extends over said bumper groove in a non-impacted condition, and extends into said bumper groove in an impacted condition to bi-directionally absorb impact forces applied to said enlarged head portion of said guide pin assembly during operation of the associated metal forming die.

11. A guide pin assembly as set forth in claim 1, wherein:

said guide pin head ring is constructed of a rigid material having sufficient radial resiliency that said guide pin head ring elastically deforms both circumferentially and radially outwardly when said guide pin head ring is pressed onto said guide pin body to snap said second retainer groove over and onto said radially outward portion of said retainer ring, and thereafter apply radially inwardly oriented resilient constricting forces against said retainer ring that securely retain said retainer ring in said first and second retainer grooves in said guide pin body and said guide pin head ring when said guide pin assembly is in said assembled condition.

12. A guide pin assembly as set forth in claim 1, wherein:

said counterbore of said guide pin head ring has a predetermined width measured radially between said interior sidewall of said guide pin head ring and said counterbore wall; and said support collar portion of said guide pin head cap has a predetermined width measured radially between said interior sidewall and said exterior sidewall of said support collar, which is greater than said predetermined width of said counterbore, such that said guide pin head cap is pressed axially onto said guide pin head ring with an interference fit between said support collar portion of said guide pin head cap and said counterbore wall of said guide pin head ring.

13. A guide pin assembly as set forth in claim 1, wherein:

said support collar of said guide pin head cap includes an inwardly facing free end edge which abuts at least a portion of said retainer ring when said guide pin head ring is pressed onto said guide pin body to assist shifting said second retainer groove over and onto said radially outward portion of said retainer ring.

14. A guide pin assembly as set forth in claim 1, wherein:

said guide pin assembly is machine pressed into said assembled condition, such that said support collar of said guide pin head cap is inelastically deformed to completely fill any open space between said exterior surface of said guide pin body and said counterbore wall in said guide pin head ring, as well as any open space between said retainer ring and said second retainer groove in said guide pin head ring, so as to insure that all parts of said guide pin assembly are fully and solidly seated to withstand repeated, high impact forces.

15. A guide pin assembly as set forth in claim 1, wherein:

said exterior sidewall of said guide pin head ring has an assembled shape that is substantially cylindrical when said guide pin assembly is in said assembled condition; and said exterior sidewall of said guide pin head ring has a preassembled shape that tapers radially inwardly adjacent said outwardly facing end edge thereof, such that the radially oriented circumferential elastic deformation of said guide pin head ring which occurs during pressing of the same onto said guide pin body shifts the configuration of said exterior sidewall of said guide pin head ring from said tapered preassembled shape to said substantially cylindrical assembled shape when said guide pin assembly is in said assembled condition.

16. A guide pin assembly as set forth in claim 1, wherein:

said inwardly oriented interior face of said guide pin head cap abuts against said outwardly facing end edge of said guide pin head ring when said guide pin assembly is in said assembled condition.

17. A guide pin as set forth in claim 1, wherein:

said outwardly oriented face of said guide pin head cap includes a tapered outer marginal edge which extends to, but no further than, the radially outermost portion of said outwardly facing end edge of said guide pin head ring to present a solid appearance for said enlarged head portion of said guide pin assembly, and discourage removal of said guide pin head cap from said guide pin head ring.

18. A guide pin assembly as set forth in claim 1, including:

a bumper groove extending circumferentially about said exterior surface of said guide pin body at an axial location disposed immediately inwardly of said inwardly facing end edge of said guide pin head ring in said assembled condition, and having a generally arcuate shape that opens radially outwardly; and a resilient dampening washer having an annular plan shape with a circular interior side wall that extends over said bumper groove in a non-impacted condition, and extends into said bumper groove in an impacted condition to bi-directionally absorb impact forces applied to said enlarged head portion of said guide pin assembly during operation of the associated metal forming die.

19. In a metal forming die having first and second die members which mutually converge and diverge to form metal parts, the improvement of a guide pin assembly, comprising:

a guide pin body having a generally cylindrical shape, with a predetermined outside diameter, and including:

a first end portion operably attached to said first die member;

a second end portion disposed generally opposite said first end portion, and received in an associated aperture in said second die member;

a medial portion disposed between said first and second end portions, and having a generally hard, smooth finished exterior surface for precisely guiding the converging and diverging motion between said first and second die members;

a first retainer groove extending circumferentially about said exterior surface at an axial location disposed generally adjacent to said second end portion of said guide pin body, and having a generally arcuate shape that opens radially outwardly;

a guide pin head ring having a generally annular plan configuration, and including:

a generally cylindrically shaped exterior sidewall with a predetermined outside diameter that is greater than said predetermined outside diameter of said guide pin body, a generally cylindrically shaped interior sidewall with a predetermined inside diameter that is generally commensurate with said predetermined outside diameter of said guide pin body, a generally annularly shaped outwardly facing end edge, and a generally annularly shaped inwardly facing end edge;

a second retainer groove extending circumferentially about a medial portion of said interior sidewall, and having a generally arcuate shape that opens radially inwardly, and is generally axially aligned with said first retainer groove in said guide pin body when said guide pin assembly is in an assembled condition;

a counterbore formed into said outwardly facing end edge of said guide pin head ring, recessed into said interior sidewall of said guide pin head ring and extending generally axially from said outwardly facing end edge to said second retainer groove, and defining a counterbore wall;

a retainer ring having a radially inward portion thereof closely received and retained in said first retainer groove in said guide pin body, and a radially outward portion thereof protruding radially outwardly from said exterior surface of said guide pin body and being closely received and retained in said second retainer groove in said guide pin head ring to fixedly axially mount said guide pin head ring on said second end portion of said guide pin body and define an enlarged head portion of said guide pin assembly that serves to positively limit travel between the first and second die members;

a guide pin head cap having a generally circular plan configuration, and including:

an outwardly oriented exterior face;

an inwardly oriented interior face;

a generally annularly shaped support collar protruding axially inwardly from said interior face of said guide pin head cap, with a radially interior side wall defining a socket in which said second end portion of said guide pin body is received, and a radially exterior sidewall which is closely received against said counterbore wall, such that said support collar is securely retained in said counterbore in said guide pin head ring and said retainer ring is positively captured in said first retainer groove in said guide pin body and said second retainer groove in said guide pin head ring, such that said guide pin head ring is securely supported on said second end portion of said guide pin assembly during repeated, mutual convergence and divergence of said first and second die members.

20. A metal forming die as set forth in claim 19, wherein:

said retainer ring has a generally annular plan shape with a predetermined outside diameter associated with said radially outward portion thereof, and a generally circular radial cross-sectional configuration;

said first retainer groove in said guide pin body is defined by a first arcuate groove surface having a shape and size that is generally commensurate with the shape and size of said radially inward portion of said retainer ring and abuttingly supports the same against said first arcuate groove surface; and said second retainer groove and said counterbore wall in said guide pin head ring intersect along a radially inwardly oriented rim which has a pretermined plan diameter that is less than said predetermined outside diameter of said retainer ring, whereby said guide pin head ring is pressed over and onto said guide pin body with an interference fit between said retainer ring and said first and second retainer grooves.

21. A metal forming die as set forth in claim 19, wherein:

said guide pin head ring is constructed of a rigid material having sufficient radial resiliency that said guide pin head ring elastically deforms both circumferentially and radially outwardly when said guide pin head ring is pressed onto said guide pin body to snap said second retainer groove over and onto said radially outward portion of said retainer ring, and thereafter apply radially inwardly oriented resilient constricting forces against said retainer ring that securely retain said retainer ring in said first and second retainer grooves in said guide pin body and said guide pin head ring when said guide pin assembly is in said assembled condition.

22. A metal forming die as set forth in claim 19, wherein:

said counterbore of said guide pin head ring has a predetermined width measured radially between said interior sidewall of said guide pin head ring and said counterbore wall; and said support collar of said guide pin head cap has a predetermined width measured radially between said interior sidewall and said exterior sidewall of said support collar portion, which is greater than said predetermined width of said counterbore, such that said guide pin head cap is pressed axially onto said guide pin head ring with an interference fit between said support collar of said guide pin head cap and said counterbore wall of said guide pin head ring.

23. A metal forming die as set forth in claim 19, wherein:

said support collar of said guide pin head cap includes an inwardly facing free end edge which abuts at least a portion of said retainer ring when said guide pin head ring is pressed onto said guide pin body to assist shifting said second retainer groove over and onto said radially outward portion of said retainer ring.

24. A metal forming die as set forth in claim 19, wherein:

said guide pin assembly is machine pressed into said assembled condition, such that said support collar of said guide pin head cap is inelastically deformed to completely fill any open space between said exterior surface of said guide pin body and said counterbore wall in said guide pin head ring, as well as any open space between said retainer ring and said second retainer groove in said guide pin head ring, so as to insure that all parts of said guide pin assembly are fully and solidly seated to withstand repeated, high impact forces.

25. A metal forming die as set forth in claim 19, wherein:

said exterior sidewall of said guide pin head ring has an assembled shape that is substantially cylindrical when said guide pin assembly is in said assembled condition; and said exterior sidewall of said guide pin head ring has a preassembled shape that tapers radially inwardly adjacent said outwardly facing end edge thereof, such that the radially oriented circumferential elastic deformation of said guide pin head ring which occurs during machine pressing of the same onto said guide pin body shifts the configuration of said exterior sidewall of said guide pin head ring from said tapered pre-assembled shape to said substantially cylindrical assembled shape when said guide pin assembly is in said assembled condition.

26. A metal forming die as set forth in claim 19, wherein:

said inwardly oriented interior face of said guide pin head cap abuts against said outwardly facing end edge of said guide pin head ring when said guide pin assembly is in said assembled condition.

27. A metal forming die as set forth in claim 19, wherein:

said outwardly oriented face of said guide pin head cap includes a tapered outer marginal edge which extends to, but no further than, the radially outermost portion of said outwardly facing end edge of said guide pin head ring to present a solid appearance for said enlarged head portion of said guide pin assembly, and discourage removal of said guide pin head cap from said guide pin head ring.

28. A metal forming die as set forth in claim 19, including:

a bumper groove extending circumferentially about said exterior surface of said guide pin body at an axial location disposed immediately inwardly of said inwardly facing end edge of said guide pin head ring in said assembled condition, and having a generally arcuate shape that opens radially outwardly; and a resilient dampening washer having an annular plan shape with a circular interior side wall that extends over said bumper groove in a non-impacted condition, and extends into said bumper groove in an impacted condition to bi-directionally absorb impact forces applied to said enlarged head portion of said guide pin assembly during operation of said metal forming die.

29. A method for making a guide pin assembly for metal forming dies of the type having first and second die members which mutually converge and diverge to form metal parts, comprising:

forming a guide pin body with a generally cylindrical shape, a predetermined outside diameter, a first end portion configured for secure operable attachment with the first die member, a second end portion disposed generally opposite the first end portion and configured to be received in an associated aperture in the second die member, and a medial portion disposed between the first and second end portions, and having a generally hard, smooth finished exterior surface for precisely guiding the converging and diverging motion between the first and second die members;

forming a first retainer groove in the guide pin body extending circumferentially about the exterior surface at an axial location disposed generally adjacent to the second end portion of the guide pin body with a generally arcuate shape that opens radially outwardly;

forming a guide pin head ring with a generally annular plan configuration, a generally cylindrically shaped exterior sidewall having a predetermined outside diameter that is greater than the predetermined outside diameter of the guide pin body, a generally cylindrically shaped interior sidewall with a predetermined inside diameter that is generally commensurate with the predetermined outside diameter of the guide pin body, a generally annularly shaped outwardly facing end edge and a generally annularly shaped inwardly facing end edge;

forming a second retainer groove in the guide pin ring head extending circumferentially about a medial portion of the interior sidewall with a generally arcuate shape that opens radially inwardly, and is generally axially aligned with the first retainer groove in the guide pin body when the guide pin assembly is in an assembled condition;

forming a counterbore in the outwardly facing end edge of the guide pin head ring that is recessed into the interior sidewall of the guide pin head ring, extends generally axially from the outwardly facing end edge to the second retainer groove, and defines a counterbore wall;

providing a retainer ring having a radially inward portion shaped for close reception in the first retainer groove in the guide pin body, and a radially outward portion which protrudes radially outwardly from the exterior surface of the guide pin body and is shaped for close reception in the second retainer groove in the guide pin head ring;

forming a guide pin head cap with a generally circular plan configuration, an outwardly oriented exterior face, an inwardly oriented interior face, and a generally annularly shaped support collar protruding axially inwardly from the interior face of the guide pin head cap, having a free end edge, a radially interior side wall defining a socket shaped to closely receive therein the second end portion of the guide pin body, and a radially exterior sidewall shaped to be closely received against the counterbore wall;

positioning the radially inward portion of the retainer ring in the first retainer groove in the guide pin body;

sliding the guide pin head ring onto and over the guide pin body from the first end portion thereof until the guide pin head ring contacts at least a portion of the retainer ring mounted in the first retainer groove on the guide pin body;

positioning the guide pin head cap over the outwardly facing end edge of the guide pin head ring with at least a portion of the second end portion of the guide pin body received in the socket in the guide pin head cap, and at least a portion of the support collar of the guide pin head cap received in the counterbore in the guide pin head ring;

converging the guide pin head cap and the guide pin head ring until at least a portion of the free end edge of the support ring on the guide pin head cap contacts at least a portion of the retainer ring mounted in the first retainer groove on the guide pin body;

pressing the guide pin head cap and the guide pin head ring together, causing engagement of the free end edge of the support ring against the retainer ring mounted in the first retainer groove on the guide pin body, and thereby shifting the radially outward portion of the retainer ring into the second retainer ring groove in the guide pin head ring to fixedly axially mount the guide pin head ring on the second end portion of the guide pin body and define an enlarged head portion of the guide pin assembly that serves to positively limit travel between the first and second die members;

further pressing the guide pin head cap and the guide pin head ring together until the second end portion of the guide pin body is fully received in the socket in the guide pin head cap, the support collar portion of the guide pin head cap is fully received in the counterbore in the guide pin head ring, and the inwardly oriented interior face of the guide pin head cap abuts with the outwardly facing end edge of the guide pin head ring, whereby the retainer ring is positively captured in the first retainer groove in the guide pin body and the second retainer groove in the guide pin head ring to rigidly support the guide pin head ring on the second end portion of said guide pin body to withstand impact forces applied to the enlarged head portion of the guide pin assembly during repeated, mutual convergence and divergence of the first and second die members.

30. A method as set forth in claim 29, wherein:

said retainer ring providing step includes selecting a split C-ring having a predetermined outside diameter, and a generally circular radial cross-sectional shape;

said guide pin body forming step includes forming the first retainer groove with a first arcuate groove surface having a shape and size that is generally commensurate with the shape and size of the radially inward portion of the retainer ring and abuttingly supports the same against the first arcuate groove surface; and said guide pin head ring forming step includes forming the second retainer groove and the counterbore wall to intersect along a radially inwardly oriented rim which has a predetermined plan diameter that is less than the predetermined outside diameter of the retainer ring; and said pressing step includes machine pressing the guide pin head ring over and onto the guide pin body with an interference fit between the retainer ring and the first and second retainer grooves.

31. A method as set forth in claim 30, wherein:

said guide pin head ring forming step includes forming the guide pin head ring from a rigid material having sufficient radial resiliency that the guide pin head ring elastically deforms both circumferentially and radially outwardly during said pressing step when the guide pin head ring is pressed onto said guide pin body and snaps the second retainer groove over and onto the radially outward portion of the retainer ring, and thereafter applies radially inwardly oriented resilient constricting forces against the retainer ring that securely retain the retainer ring in the first and second retainer grooves in the guide pin body and the guide pin head ring when the guide pin assembly is in the assembled condition.

32. A method as set forth in claim 31, wherein:

said counterbore forming step includes forming the counterbore in the guide pin head ring with a predetermined width measured radially between the interior sidewall of the guide pin head ring and the counterbore wall; and said guide pin cap forming step includes forming the support collar portion of the guide pin head cap with a predetermined width measured radially between the interior sidewall and the exterior sidewall of the guide pin head ring such that the predetermined width of the support collar is greater than the predetermined width of the counterbore; and said further pressing step includes machine pressing the guide pin head cap onto the guide pin head ring with an interference fit between the support collar of the guide pin head cap and the counterbore of the guide pin head ring.

33. A method as set forth in claim 32, wherein:

said further pressing step includes pressing the free end edge of the support collar of the guide pin head cap abuttingly against at least a portion of the retainer ring to assist shifting the second retainer groove over and onto the radially outward portion of the retainer ring.

34. A method as set forth in claim 33, wherein:

said further pressing step includes machine pressing the support collar of the guide pin head cap with sufficient force to inelastically deform the support collar and completely fill any open space between the exterior surface of the guide pin body and the counterbore wall in the guide pin head ring, as well as any open space between the retainer ring and the second retainer groove in the guide pin head ring, so as to insure that all parts of the guide pin assembly are fully and solidly seated to withstand repeated, high impact forces.

35. A method as set forth in claim 34, wherein:

said guide pin head ring forming step includes:

forming the exterior sidewall of the guide pin head ring with an assembled shape that is substantially cylindrical; and forming the exterior sidewall of the guide pin head with a preassembled shape that tapers radially inwardly adjacent the outwardly facing end edge thereof, whereby the radially oriented circumferential elastic deformation of the guide pin head ring which occurs during said further pressing step shifts the configuration of the exterior sidewall of the guide pin head ring to the assembled, substantially cylindrical shape when the guide pin assembly is in the assembled condition.

36. A method as set forth in claim 35, wherein:

said further pressing step comprises pressing the inwardly oriented interior face of the guide pin head cap a buttingly against the outwardly facing end edge of the guide pin head ring.

37. A method as set forth in claim 36, wherein:

said guide pin head cap forming step includes forming the outwardly oriented face of the guide pin head cap with a tapered outer marginal edge which extends to, but no further than, the radially outermost portion of the outwardly facing end edge of the guide pin head ring to present a solid appearance for the enlarged head portion of the guide pin assembly, and discourage removal of the guide pin head cap from the guide pin head ring.

38. A method as set forth in claim 37, wherein:

said guide pin body forming step includes forming a bumper groove in the guide pin body, extending circumferentially about the exterior surface of the guide pin body at an axial location disposed immediately inwardly of the inwardly facing end edge of the guide pin head ring in the assembled condition, and having a generally arcuate shape that opens radially outwardly; and including positioning a resilient dampening washer having an annular plan shape in the bumper groove with the circular interior side wall of the washer extending over the bumper groove in a non-impacted condition and extending into the bumper groove in an impacted condition to bi-directionally absorb impact forces applied to the enlarged head portion of the guide pin assembly during operation of the associated metal forming die.

39. A method as set forth in claim 38, wherein:

said pressing step and said further pressing step is performed as a single action, substantially continuous, machine pressing the guide pin head cap, the retainer ring, the guide pin head ring and the guide pin body tightly and permanently together.

40. In a method for making a metal forming die of the type having first and second die members which mutually converge and diverge to form metal parts, comprising:

forming a guide pin body with a generally cylindrical shape, a predetermined outside diameter, a first end portion configured for secure operable attachment with the first die member, a second end portion disposed generally opposite the first end portion and configured to be received in an associated aperture in the second die member, and a medial portion disposed between the first and second end portions, and having a generally hard, smooth finished exterior surface for precisely guiding the converging and diverging motion between the first and second die members;

forming a first retainer groove in the guide pin body extending circumferentially about the exterior surface at an axial location disposed generally adjacent to the second end portion of the guide pin body with a generally arcuate shape that opens radially outwardly;

forming a guide pin head ring with a generally annular plan configuration, a generally cylindrically shaped exterior sidewall having a predetermined outside diameter that is greater than the predetermined outside diameter of the guide pin body, a generally cylindrically shaped interior sidewall with a predetermined inside diameter that is generally commensurate with the predetermined outside diameter of the guide pin body, a generally annularly shaped outwardly facing end edge and a generally annularly shaped inwardly facing end edge;

forming a second retainer groove in the guide pin head ring extending circumferentially about a medial portion of the interior sidewall with a generally arcuate shape that opens radially inwardly, and is generally axially aligned with the first retainer groove in the guide pin body when the guide pin assembly is in an assembled condition;

forming a counterbore in the outwardly facing end edge of the guide pin head ring that is recessed into the interior sidewall of the guide pin head ring, extends generally axially from the outwardly facing end edge to the second retainer groove, and defines a counterbore wall;

providing a retainer ring having a radially inward portion shaped for close reception in the first retainer groove in the guide pin body, and a radially outward portion which protrudes radially outwardly from the exterior surface of the guide pin body and is shaped for close reception in the second retainer groove in the guide pin head ring;

forming a guide pin head cap with a generally circular plan configuration, an outwardly oriented exterior face, an inwardly oriented interior face, and a generally annularly shaped support collar protruding axially inwardly from the interior face of the guide pin head cap, having a free end edge, a radially interior side wall defining a socket shaped to closely receive therein the second end portion of the guide pin body, and a radially exterior sidewall shaped to be closely received against the counterbore wall;

positioning the radially inward portion of the retainer ring in the first retainer groove in the guide pin body;

sliding the guide pin head ring onto and over the guide pin body from the first end portion thereof until the guide pin head ring contacts at least a portion of the retainer ring mounted in the first retainer groove on the guide pin body;

positioning the guide pin head cap over the outwardly facing end edge of the guide pin head ring with at least a portion of the second end portion of the guide pin body received in the socket in the guide pin head cap, and at least a portion of the support collar of the guide pin head cap received in the counterbore in the guide pin head ring;

converging the guide pin head cap and the guide pin head ring until at least a portion of the free end edge of the support ring on the guide pin head cap contacts at least a portion of the retainer ring mounted in the first retainer groove on the guide pin body;

pressing the guide pin head cap and the guide pin head ring together, causing engagement of the free end edge of the support ring against the retainer ring mounted in the first retainer groove on the guide pin body, and thereby shifting the radially outward portion of the retainer ring into the second retainer ring groove in the guide pin head ring to fixedly axially mount the guide pin head ring on the second end portion of the guide pin body and define an enlarged head portion of the guide pin assembly that serves to positively limit travel between the first and second die members;

further pressing the guide pin head cap and the guide pin head ring together until the second end portion of the guide pin body is fully received in the socket in the guide pin head cap, the support collar of the guide pin head cap is fully received in the counterbore in the guide pin head ring, and the inwardly oriented interior face of the guide pin head cap abuts with the outwardly facing end edge of the guide pin head ring, whereby the retainer ring is positively captured in the first retainer groove in the guide pin body and the second retainer groove in the guide pin head ring, and rigidly support the guide pin head ring on the second end portion of said guide pin body;

mounting the first end portion of the guide pin body to said first die member;

positioning the second end portion of the guide pin body in an associated aperture in the second die member, such that the enlarged head portion of the guide pin assembly positively and accurately limits travel between the first and second die members during repeated, mutual convergence and divergence of the first and second die members.

41. A method as set forth in claim 40, wherein:

said retainer ring providing step includes selecting a split C-ring having a predetermined outside diameter, and a generally circular radial cross-sectional shape;

said guide pin body forming step includes forming the first retainer groove with a first arcuate groove surface having a shape and size that is generally commensurate with the shape and size of the radially inward portion of the retainer ring and abuttingly supports the same against the first arcuate groove surface; and said guide pin head ring forming step includes forming the second retainer groove and the counterbore wall to intersect along a radially inwardly oriented rim which has a predetermined plan diameter that is less than the predetermined outside diameter of the retainer ring; and said pressing step includes machine pressing the guide pin head ring over and onto the guide pin body with an interference fit between the retainer ring and the first and second retainer grooves.

42. A method as set forth in claim 40, wherein:

said guide pin head ring forming step includes forming the guide pin head ring from a rigid material having sufficient radial resiliency that the guide pin head ring elastically deforms both circumferentially and radially outwardly during said pressing step when the guide pin head ring is pressed onto said guide pin body and snaps the second retainer groove over and onto the radially outward portion of the retainer ring, and thereafter applies radially inwardly oriented constricting forces against the retainer ring that securely retain the retainer ring in the first and second retainer grooves in the guide pin body and the guide pin head ring when the guide pin assembly is in the assembled condition.

43. A method as set forth in claim 40, wherein:

said counterbore forming step includes forming the counterbore in the guide pin head ring with a predetermined width measured radially between the interior sidewall of the guide pin head ring and the counterbore wall; and said guide pin cap forming step includes forming the support collar of the guide pin head cap with a predetermined width measured radially between the interior sidewall and the exterior sidewall of the guide pin head ring such that the predetermined width of the support collar is greater than the predetermined width of the counterbore; and said further pressing step includes machine pressing the guide pin head cap onto the guide pin head ring with an interference fit between the support collar of the guide pin head cap and the counterbore of the guide pin head ring.

44. A method as set forth in claim 40, wherein:

said further pressing step includes pressing the free end edge of the support collar of the guide pin head cap abuttingly against at least a portion of said retainer ring to assist shifting the second retainer groove over and onto the radially outward portion of the retainer ring.

45. A method as set forth in claim 40, wherein:

said further pressing step includes machine pressing the support collar of the guide pin head cap with sufficient force to inelastically deform the support collar and completely fill any open space between the exterior surface of the guide pin body and the counterbore wall in the guide pin head ring, as well as any open space between the retainer ring and the second retainer groove in the guide pin head ring, so as to insure that all parts of the guide pin assembly are fully and solidly seated to withstand repeated, high impact forces.

46. A method as set forth in claim 40, wherein:

said guide pin head ring forming step includes:

forming the exterior sidewall of the guide pin head ring with an assembled shape that is substantially cylindrical; and forming the exterior sidewall of the guide pin head with a preassembled shape that tapers radially inwardly adjacent the outwardly facing end edge thereof, whereby the radially oriented circumferential elastic deformation of the guide pin head ring which occurs during said further pressing step shifts the configuration of the exterior sidewall of the guide pin head ring to the assembled substantially cylindrical shape when the guide pin assembly is in the assembled condition.

47. A method as set forth in claim 40, wherein:

said further pressing step comprises pressing the inwardly oriented interior face of the guide pin head cap a buttingly against the outwardly facing end edge of the guide pin head ring.

48. A method as set forth in claim 40, wherein:

said guide pin head cap forming step includes forming the outwardly oriented face of the guide pin head cap with a tapered outer marginal edge which extends to, but no further than, the radially outermost portion of the outwardly facing end edge of the guide pin head ring to present a solid appearance for the enlarged head portion of the guide pin assembly, and discourage removal of the guide pin head cap from the guide pin head ring.

49. A method as set forth in claim 40, wherein:

said guide pin body forming step includes forming a bumper groove in the guide pin body, extending circumferentially about the exterior surface of the guide pin body at an axial location disposed immediately inwardly of the inwardly facing end edge of the guide pin head ring in the assembled condition, and having a generally arcuate shape that opens radially outwardly; and including positioning a resilient dampening washer having an annular plan shape in the bumper groove with the circular interior side wall of the washer extending over the bumper groove in a non-impacted condition and extending into the bumper groove in an impacted condition to bi-directionally absorb impact forces applied to the enlarged head portion of the guide pin assembly during operation of the associated metal forming die.

50. A method as set forth in claim 40, wherein:

said pressing step and said further pressing step is performed as a single action, substantially continuous, machine pressing of the guide pin head cap, the retainer ring, the guide pin head ring and the guide pin body tightly and permanently together.

* * * * *